US010565971B2

(12) United States Patent
Wilfer

(10) Patent No.: US 10,565,971 B2
(45) Date of Patent: Feb. 18, 2020

(54) SET CONSISTING OF A QUICK-ASSEMBLY SUPPORT AND A SUPPORT PLATE

(71) Applicant: Hans-Peter Wilfer, Markneukirchen (DE)

(72) Inventor: Hans-Peter Wilfer, Markneukirchen (DE)

( * ) Notice: Subject to any disclaimer, the term of this patent is extended or adjusted under 35 U.S.C. 154(b) by 0 days.

(21) Appl. No.: 15/860,915

(22) Filed: Jan. 3, 2018

(65) Prior Publication Data

US 2020/0027433 A1 Jan. 23, 2020

(30) Foreign Application Priority Data

Nov. 6, 2017 (DE) ..... 10 2017 125 822

(51) Int. Cl.
*G10H 1/34* (2006.01)
*G10G 5/00* (2006.01)

(52) U.S. Cl.
CPC ..... *G10H 1/348* (2013.01); *G10G 5/00* (2013.01)

(58) Field of Classification Search
USPC ..... 248/224.8, 223.21, 225.11; 84/746, 721
See application file for complete search history.

(56) References Cited

U.S. PATENT DOCUMENTS 2,537,662 A * 1/1951 Flora ..... F16B 5/065 24/293
3,425,033 A * 1/1969 Pfund ..... B60R 25/1003 200/42.01
4,697,774 A * 10/1987 Sarton ..... F16L 3/26 24/297
4,893,777 A * 1/1990 Gassaway ..... E05B 73/0082 211/8
4,989,815 A * 2/1991 McAuley ..... A47B 57/42 211/59.1
5,257,861 A * 11/1993 Domenig ..... A47B 88/43 248/223.41
5,314,355 A * 5/1994 Halvonik ..... H01R 13/436 439/638

(Continued)

*Primary Examiner* — Alfred J Wujciak
(74) *Attorney, Agent, or Firm* — Scarinci Hollenbeck, LLC; Libby Babu Varghese

(57) ABSTRACT

The invention relates to a set consisting of a support plate and at least one quick-assembly support, wherein lateral feet or frame elements below the support plate form a free space, which can be used, among other things, for cabling purposes or for accommodating a power supply unit, wherein the quick-assembly support is designed and intended for mounting an in particular electronic component on the support plate, wherein the support plate comprises a plurality of elongated holes arranged in parallel in a predetermined pattern, wherein pairs of elongated holes with a first elongated hole and a second elongated hole are arranged in a predetermined grid spacing (A) perpendicular to the longitudinal extension of the two elongated holes, wherein the elongated holes comprise straight longitudinal edges extending parallel to one another, and wherein the quick-assembly support comprises a first fastening element and a second fastening element, which are arranged on the quick-assembly support at a distance matched to the grid spacing (A), wherein the first fastening element is designed to interlock with the first elongated hole and the second fastening element is designed to interlock with the second elongated hole.

11 Claims, 5 Drawing Sheets

(56) References Cited

U.S. PATENT DOCUMENTS

| | | | | |
|---|---|---|---|---|
| 5,740,995 | A * | 4/1998 | Richter | B60N 3/101 248/207 |
| 6,036,071 | A * | 3/2000 | Hartmann | B60R 11/00 224/482 |
| 9,705,298 | B2 * | 7/2017 | Dinh | H02G 3/185 |
| 10,192,536 | B1 * | 1/2019 | Jia | G10H 1/0008 |
| 2011/0247969 | A1 * | 10/2011 | Pryde | B07B 1/4645 209/405 |
| 2018/0151162 | A1 * | 5/2018 | McKenzie | G10H 1/348 |

* cited by examiner

Fig. 2a
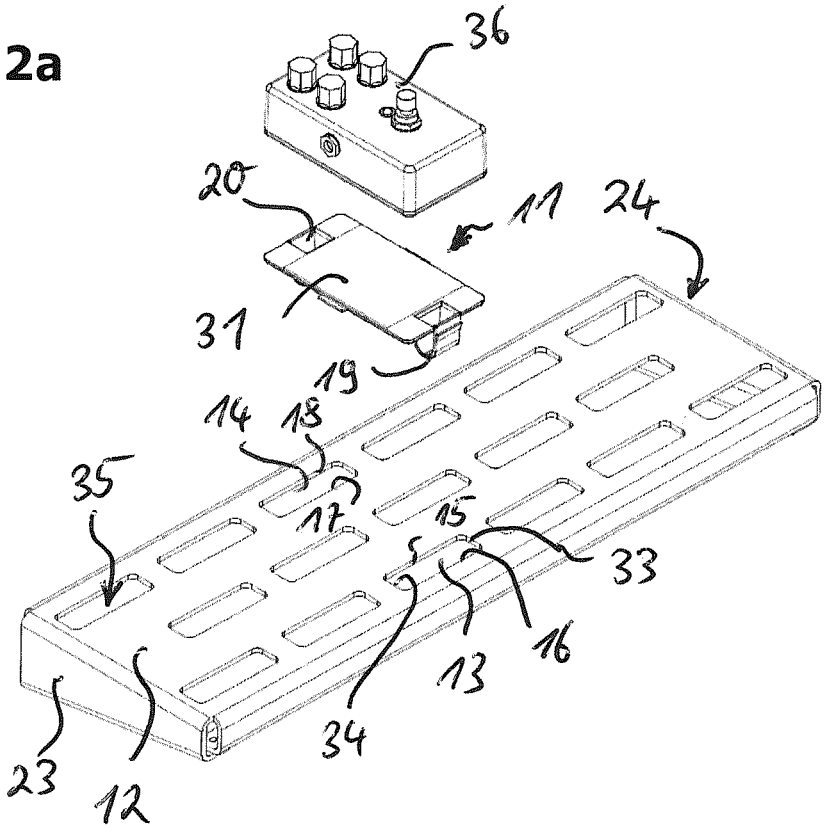
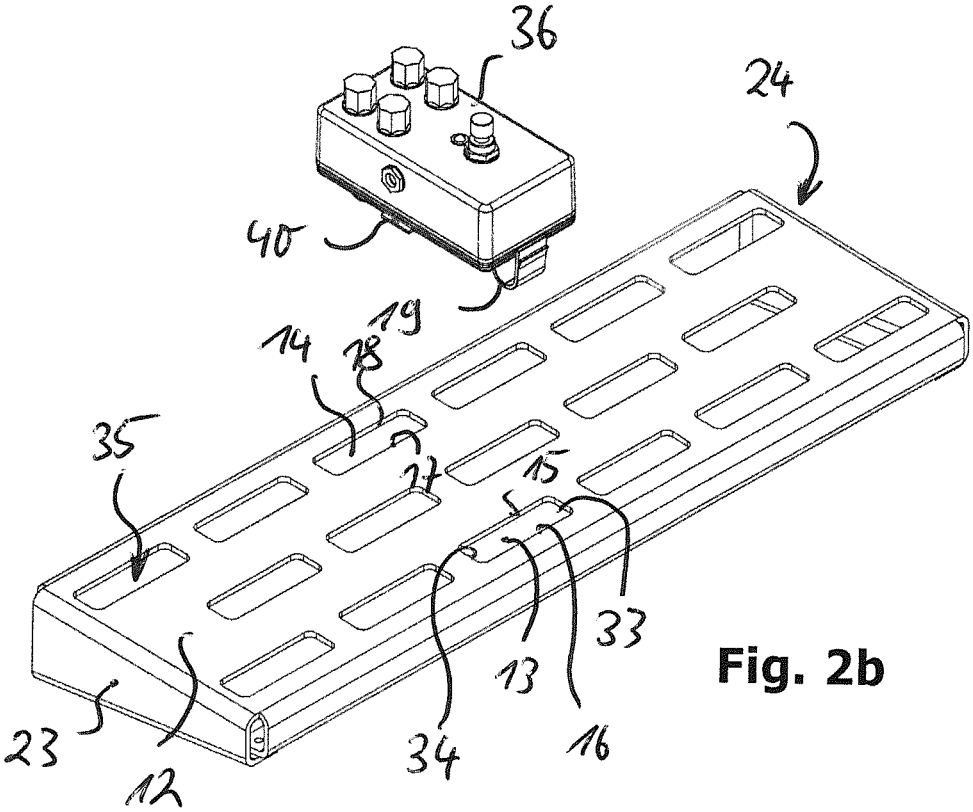
Fig. 2b

SET CONSISTING OF A QUICK-ASSEMBLY SUPPORT AND A SUPPORT PLATE

This application claims priority to foreign German application DE102017125822.1 filed on Nov. 6, 2017.

BACKGROUND

The invention relates to a set consisting of a support plate arranged freely above a base surface by means of feet or frame elements and at least one quick-assembly support according to claim 1.

Support plates designed as so-called pedalboards for mounting electronic components, in particular effect devices, for influencing the sound of a musical instrument operating by means of electronic amplification, such as, in particular, a guitar or bass guitar, have been known for a long time and are very popular. Such effect devices can usually be switched on and off with the foot and can comprise a plurality of operating elements on the upper side. The support plates configured as pedalboards are usually individually equipped with different effect devices by the respective guitarists or bassists. The effect devices are often detachably mounted on the support plates by means of hook and loop elements. The use of hook and loop elements thus allows virtually any reconfiguration with the objective that the effect devices remain at the respective intended position, at least in principle, even during hectic stage operation.

The mounting of the hook and loop elements or the mounting of the effect devices to the support plate via the hook and loop elements is cumbersome, however; and effect devices can sometimes become detached unintentionally, which, in the case of musical performances, can lead to undesirable disruptions.

In contrast to this, the object of the present invention is to propose an alternative mounting option for effect devices on a support plate configured as a pedalboard. The invention further proposes a corresponding method for mounting an electronic component, which can in particular be configured as an effect device, on a support plate. This object is achieved by a set according to the features of claim 1 and claim 16. Advantageous further developments are specified in the dependent claims.

BRIEF SUMMARY OF THE INVENTION

According to a core consideration of the present invention, a set is proposed consisting of a support plate and at least one quick-assembly support, wherein lateral feet or frame elements below the support plate form a free space, which can be used, among other things, for cabling purposes or for accommodating a power supply unit, wherein the quick-assembly support is designed and intended for mounting an in particular electronic component on the support plate, wherein the support plate comprises a plurality of elongated holes arranged in parallel in a predetermined pattern, wherein pairs of elongated holes with a first elongated hole and a second elongated hole are arranged in a predetermined grid spacing perpendicular to the longitudinal extension of the two elongated holes, wherein the elongated holes comprise straight longitudinal edges extending parallel to one another, and wherein the quick-assembly support comprises a first fastening element and a second fastening element, which are arranged on the quick-assembly support at a distance matched to the grid spacing, wherein the first fastening element is designed to interlock with the first elongated hole and the second fastening element is designed to interlock with the second elongated hole.

The support plate discussed here is often also referred to as a pedalboard. It is thus a support plate designed as a pedalboard. The quick-assembly support is designed and intended for mounting an in particular electronic component. The electronic components discussed here are so-called effect devices, which are designed and intended for influencing the sound of a musical instrument operating by means of electronic amplification.

A plurality of elongated holes arranged in parallel in a predetermined pattern is provided on the support plate. The elongated holes are characterized in that they comprise a longitudinal extension which corresponds to a multiple of their width, preferably at least twice, more preferably at least three times as long as wide. They are delimited on the one hand by longitudinal edges, which extend parallel to one another, and on the other hand by two opposite lateral edges, which connect the longitudinal edges. The lateral edges can either be designed to be straight, in particular extending at right angles to the longitudinal edges, or they can form a concave or convex contour. A support plate preferably comprises a plurality of elongated holes lying on a common axis L. Preferably, a plurality of rows of elongated holes, which are arranged spaced apart each other on one axis, are provided.

The quick-assembly support, which is matched to the support plate with its elongated holes arranged in the predetermined grid dimension A, preferably comprises two spaced fastening elements respectively configured to interlock with correspondingly spaced elongated holes, so that the quick-assembly support can be fixed to a respective desired position on the support plate, or detached from the support plate, quickly.

The interlocking of the quick-assembly support can take place via its first fastening element and second fastening element with the respective longitudinal edges of the first elongated hole and the second elongated hole, which face one another. However, the interlocking of the quick-assembly support can also take place via its first fastening element and second fastening element with the respective longitudinal edges of the first elongated hole and the second elongated hole, which face away from one another. Interlocking can furthermore be performed with the two opposite longitudinal edges of the first elongated hole and/or the second elongated hole.

In a preferred further development, at least one of the fastening elements, preferably both fastening elements, is resiliently constructed in such a way that the fastening elements can be snapped into the associated elongated holes only by overcoming a predetermined spring force or can be released from the elongated holes only by overcoming a predetermined spring force. This creates a particularly simple mounting option, which can function without additional locking means.

In one possible configuration, the first and/or the second fastening element respectively comprise a first or second interlock surface, which, in the interlocked position, faces the associated longitudinal edge of the respective elongated hole. Alternatively or additionally, the first fastening element and/or the second fastening element can also respectively comprise a retaining section, which encloses the associated longitudinal edge of the support plate or is provided to rest against an underside of the support plate.

In a specifically preferred configuration, at least one of the fastening elements, preferably both fastening elements, are designed as substantially U-shaped spring clips with a first leg and a second leg. In this configuration, the distance between the legs of the U-shaped spring clips can substantially correspond to the width of the elongated holes, preferably 1.0 to 1.1 times the distance between the longitudinal edges of the respective elongated holes. It can thus be provided that the legs have to be slightly compressed against one another to allow insertion into the respective elongated hole.

In a further preferred configuration, on its upper side facing away from the fastening elements, the quick-assembly support can be provided with fastening means in order to be able to mount an in particular electronic component, such as for example an effect device, thereto. In a specific further development, said fastening means can be designed as a self-adhesive surface, in particular comprise an adhesive pad applied to the quick-assembly support. The adhesive pad can, for example, be permanently applied to the quick-assembly support by means of a sealing film. Should the user want to mount an effect device on the quick-assembly support, he merely has to remove the sealing film and can then press the effect device directly onto the adhesive pad permanently attached to the quick-assembly support, thus bringing about an adhesive connection to the quick-assembly support.

The fastening means preferably comprise a predetermined width B parallel to the longitudinal extension of the elongated holes, so that a lateral displacement with simultaneous axial guidance within the elongated hole or holes is made possible. If the fastening means interact with one of the longitudinal edges of the elongated hole or both longitudinal edges of the elongated hole under a certain spring force, a displacement is possible only by overcoming a predetermined retaining force. On the one hand this allows the position of the quick-assembly support with the effect device attached thereto to be adjusted; on the other hand, it also ensures that undesirable slipping does not take place.

Lastly, a quick-assembly support, designed and intended for connection to a support plate, is claimed independently as a component of a set according to the present invention as well. It is also possible for a user to request such a quick-assembly support individually to meet a supplementary need.

BRIEF DESCRIPTION OF THE DRAWINGS

The invention is explained, also with respect to further features and advantages, in more detail in the following on the basis of the description of design examples and with reference to the accompanying drawings. The drawings show:

FIGS. 2*a* and 2*b* are an illustration of the process for mounting an effect device via a quick-assembly support on the support plate.

DETAILED DESCRIPTION OF THE INVENTION

Figure 1:
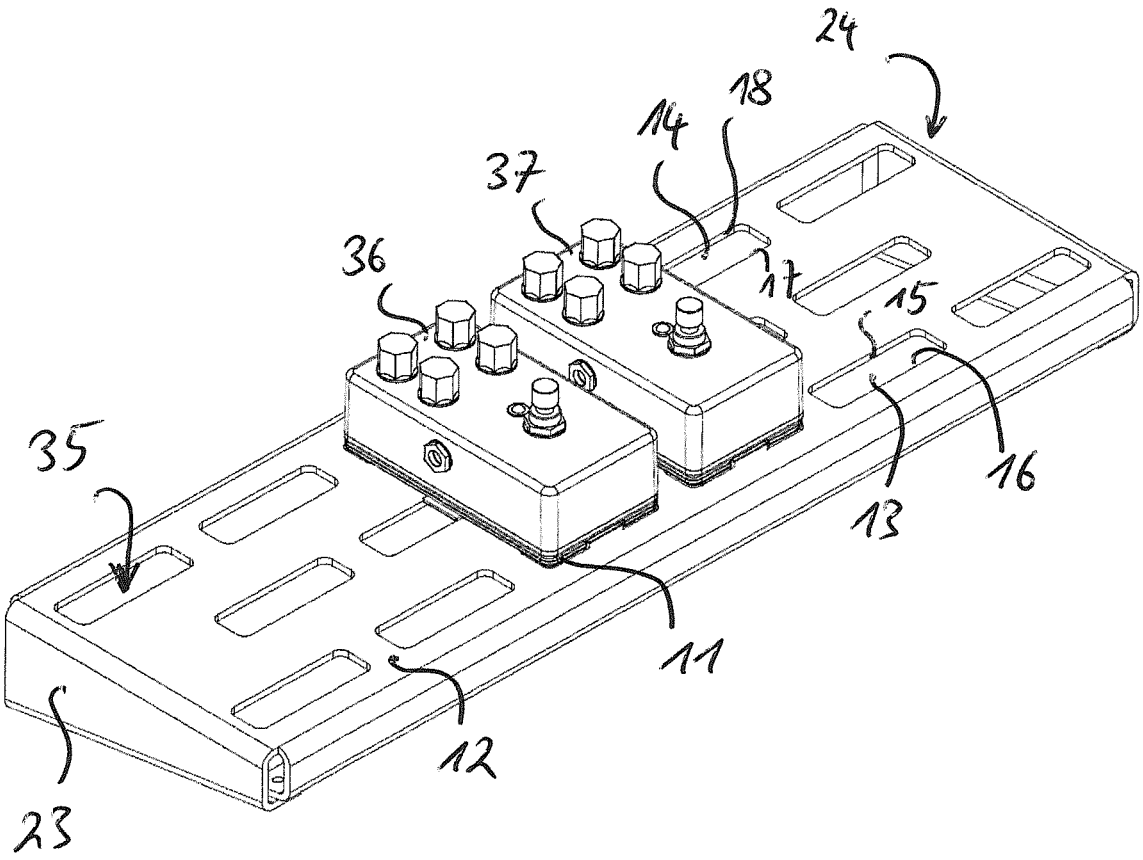
FIG. 1 is an embodiment of a support plate with two effect devices mounted thereon by means of a respective quick-assembly support according to a possible embodiment.

FIG. 1 shows an embodiment of a support plate 12 with two effect devices 36, 37 mounted thereon by means of a respective quick-assembly support 11 according to a possible embodiment. The support plate 12 comprises a plurality of elongated holes 13, 14 arranged in a specific pattern. Three rows of elongated holes, which respectively lie on a common axis, are specifically provided in the embodiment illustrated in FIG. 1. In the specific embodiment, the outermost two rows respectively comprise six elongated holes, and the middle row comprises five elongated holes. The elongated holes of the outer rows are arranged opposite one another. It goes without saying that any variations of the pattern of elongated holes illustrated here are conceivable. Support plates can in particular be configured with only two rows of elongated holes, or support plates can comprise four, five, six, seven or a higher number of elongated holes. Within certain limits, depending on the width of the support plate 12, the number of elongated holes within a row of the pattern A is freely selectable as well.

To provide sufficient space for cabling purposes and/or accommodating a power supply unit and/or to provide the fastening solution proposed here, the support plate 12 is designed with a free space 35 below the support plate 12. For this purpose, the support plate 12 comprises lateral frame elements 23, 24, which forms an angled pedalboard. In one embodiment, frame elements 23, 24 are shown angled such that one end of each frame element 23, 24 has shorter length than a second end of each frame element 23, 24. Frame elements can be provided only on two sides of the support plate, or also on three or four sides of the support plate, To ensure the mentioned free space 35, the support plate 12 can alternatively also be designed with feet. The elongated holes of the present embodiment all exhibit the same geometric contour, and comprise two opposite longitudinal edges 15, 16; 17, 18 as well as lateral edges 33, 34 disposed between said longitudinal edges. The elongated holes of the embodiment shown here are configured to be rectangular with rounded corners, They thus respectively comprise two opposite longitudinal edges 15, 16; 17, 18 extending parallel to one another, and lateral edges 33, 34 disposed between said longitudinal edges. In the embodiment illustrated here, the longitudinal edges are approximately four times as long as the lateral edges 33, 34.

An effect device 36, 37 can be detachably mounted at the desired position in opposite elongated holes 13, 14 of the outer rows of the elongated holes, via a quick-assembly support 11 respectively mounted thereto.

The process for mounting the effect devices 36, 37 via a respective associated quick-assembly support 11 is shown in greater detail in FIGS. 2*a* and 2*b*. The effect device 36 is first mounted on a base plate 38 of the quick-assembly support 11 via a fastening means 31, which is designed as an adhesive pad. A first fastening element 19 and a second fastening element 20 are disposed on the quick-assembly support 11 on the upper side 30 of the base plate 38 facing away from the adhesive pad 31. In the present embodiment, the first fastening element 19 and the second fastening element 20 are configured as substantially U-shaped bent metal strips, thereby respectively forming spring clips with a first leg 28 and a second leg 29. A catch lug 39 is formed on one or on both outer sides of the legs 28, 29, in this case on the side of the spring clips facing away from the respective opposite fastening element.

The catch lug 39 serves to interlock with the respective associated longitudinal edges 15, 16; 17, 18 of the elongated holes 13, 14, wherein the catch lug 39 forms a respective retaining section 25, 26, which rests against an underside of the support plate, and encloses the associated longitudinal edge 15, 16; 17, 18. The spring clips with the legs 28, 29 of the first fastening element 19 and/or of the second fastening element 20 can comprise a width that is slightly larger than the width of the associated elongated hole 13, 14, so that the fastening elements 19, 20, which are designed here as spring clips, abut at the longitudinal edges 15, 16; 17, 18 with an associated first interlock surface 21 or an associated second interlock surface 22 and with a specific spring pretensioning. As a result, the quick-assembly supports with the effect device 36, 37 respectively disposed thereon, are held without play in a direction transverse to the longitudinal extension of the elongated holes.

As already mentioned, FIGS. 2*a* and 2*b* illustrate the process of mounting an effect device 36, 37 on the support plate 12. The effect device 36, 37 is first mounted on the quick-assembly support 11. This preferably takes place via an adhesive pad 31, which is already disposed on the quick-assembly support on its upper side 30 facing away from the first fastening element 19 and the second fastening element 20. The adhesive pad can be sealed with a sealing film that is removed prior to mounting the effect device 36, 37, to then mount the effect device 36, 37 on the quick-assembly support 11 (FIG. 2*a*).

The unit formed by the effect device 36, 37 and the quick-assembly support 11 is then snapped into the support plate, into the respective desired elongated holes 13, 14, via the first fastening element 19 and the second fastening element 20, which in the present embodiment are respectively configured as spring clips. Spring means (not depicted), such as a foam rubber layer, for example, can be disposed on an underside of the quick-assembly support as well, so that the quick-assembly support is snapped onto the support plate 12 under a slight compression of said spring means, which can be configured as a foam rubber layer, for example. In this possible configuration, interlocking thus takes place under a predetermined pretensioning, so that the quick-assembly support is mounted without play, even in the mounting direction perpendicular to the plane of the support plate 12.

Figure 3A:
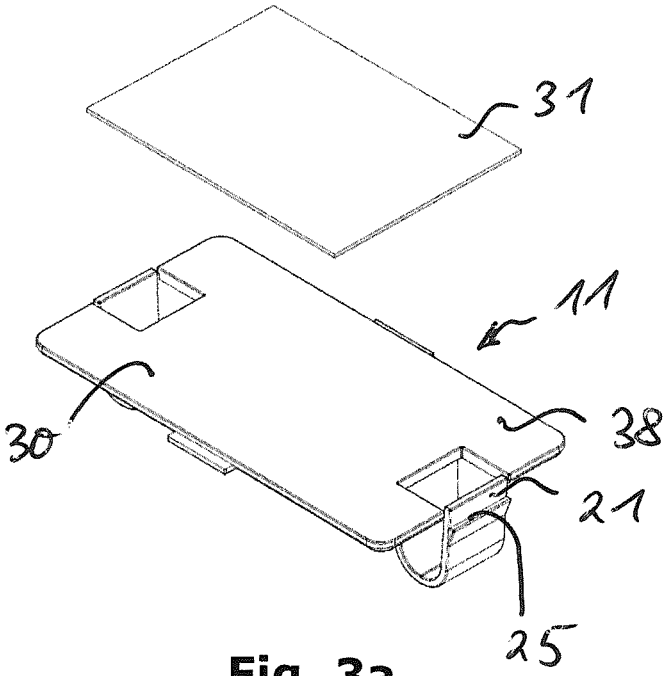
FIGS. 3*a* and 3*b* are an embodiment of a quick-assembly support and an adhesive pad in an exploded view from two different perspectives.
Figure 3B:
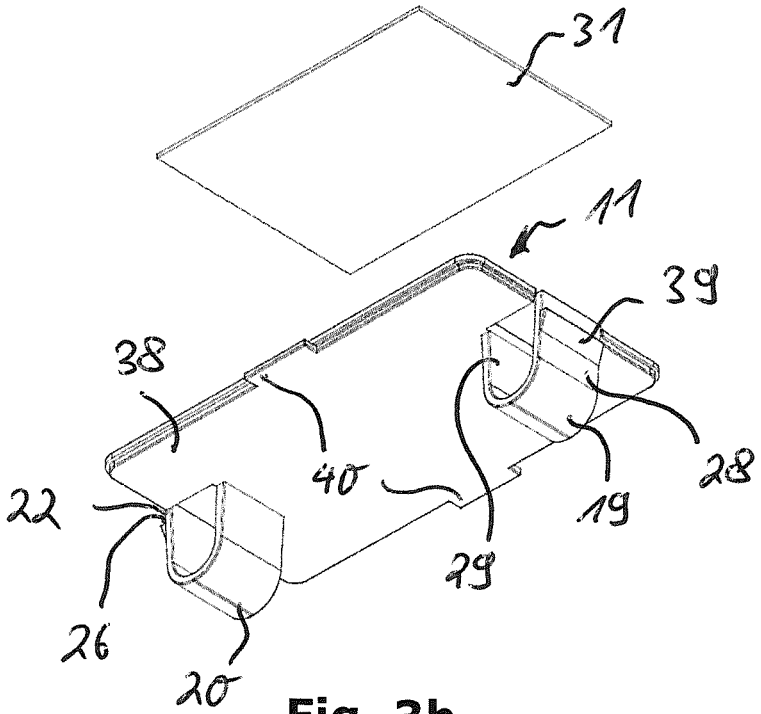

In FIGS. 3*a* and 3*b*, the quick-assembly support 11 and the adhesive pad 31 are shown in an exploded view from two different perspectives. When mounting, in particular when detaching the quick-assembly support 11 from the support plate 12, projections 40 disposed laterally on the base plate 38 serve as grip tabs to be able to grip the quick-assembly support itself, and not have to transmit the forces for detaching onto the base plate 38 via the effect device 36, 37 and the adhesive pad 31.

Figure 4:
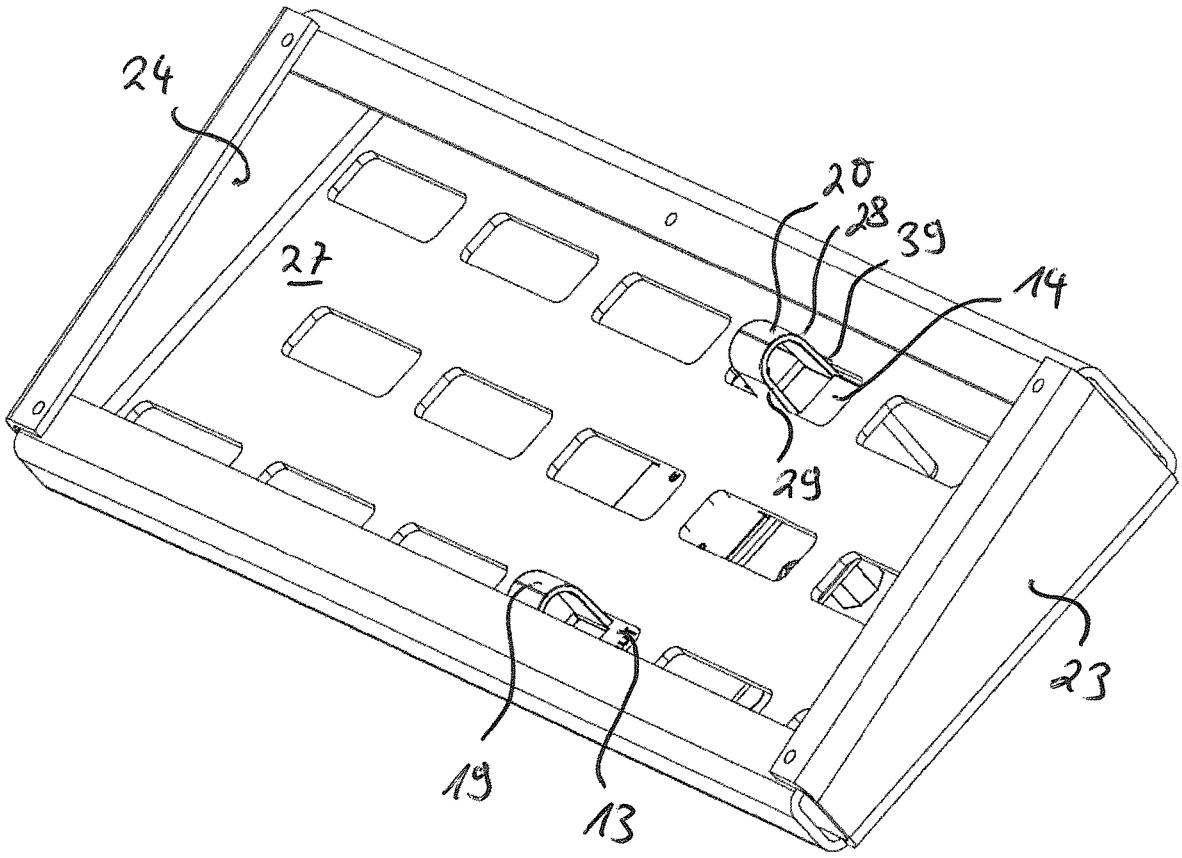
FIG. 4 is an embodiment of a support plate with an effect device mounted thereon by means of a quick-assembly support in a view from below.

FIG. 4 shows an embodiment of a support plate with an effect device mounted thereto via a quick-assembly support in a view from below, to illustrate the interlocking via the first fastening element 19 or the second fastening element 20 on the underside 27 of the support plate 12. The fastening elements 19, 20, which are configured as spring clips, are inserted into the associated elongated hole 13, 14 by overcoming the catch lug 39 in such a way that the retaining section 25, 26 formed on the catch lug 39 counteracts withdrawal by enclosing the associated longitudinal edge 15, 16; 17, 18 on the underside 27 of the support plate 12.

At the same time, the first interlock surface 21 or the second interlock surface 22 abuts the longitudinal edges 15, 16; 17, 18 as well, so that a lateral immobilization transverse to the longitudinal extension of the elongated holes is achieved.

Figure 5A:
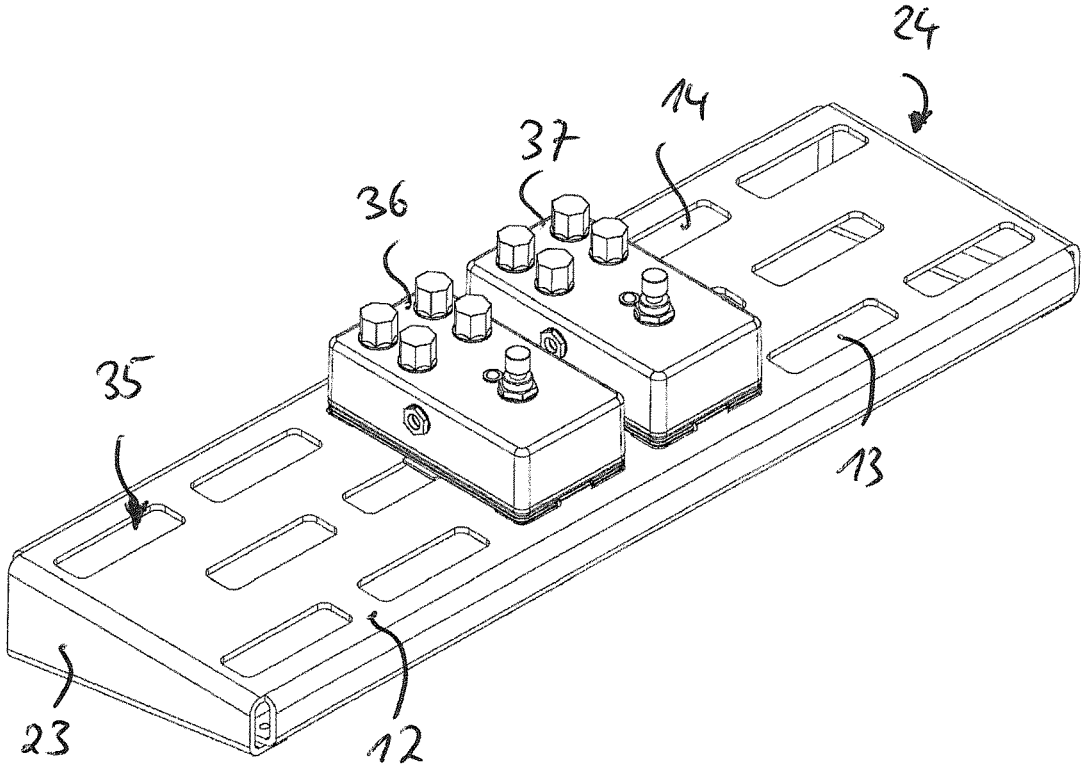
FIGS. 5*a* and 5*b* are representations to illustrate the longitudinal displaceability of the quick-assembly supports on a support plate, in order to be able to easily adjust the distances between adjacent effect devices.
Figure 5B:
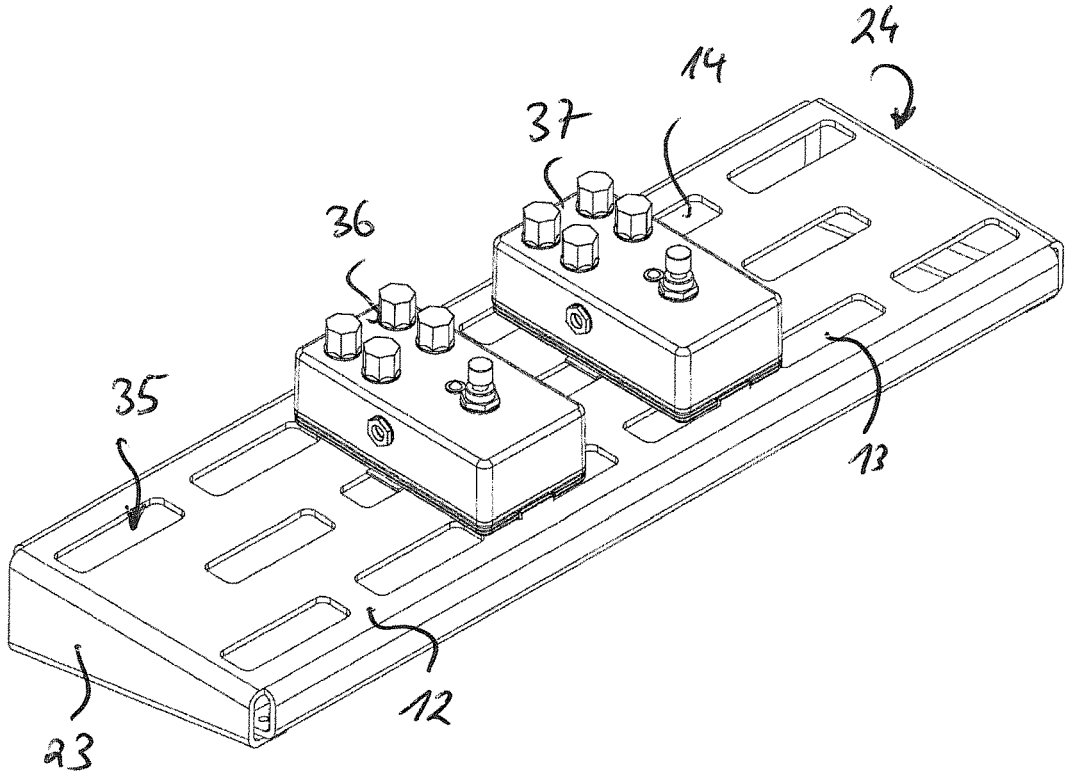

However, to be able to adjust the distances of the effect devices 36, 37, it can be provided in a preferred manner that the quick-assembly supports are arranged to be displaceable in the longitudinal direction of the elongated holes 13, 14 via the first fastening element 19 or the second fastening element 20 as can be seen in FIGS. 5*a* and 5*b*. Guidance within the elongated hole 13, 14 is achieved by means of the width of the spring clips configured as the first or second fastening element 19, 20. Due to the fact that the fastening elements 19, 20 configured as spring clips are preferably slightly compressed in the elongated hole in such a way that the first interlock surface 21 and the second interlock surface 22 abut the associated longitudinal edges 15, 16; 17, 18 with a predetermined spring force, a displacement is only possible if a defined frictional force is overcome or only if the spring clips are compressed slightly from the underside.

It goes without saying that numerous variations for configuring the fastening elements 19, 20 to create an interlocking with the associated elongated holes 13, 14 are conceivable. Instead of an effect device, other components useful for an artist in a musical performance, such as an acoustic or optical metronome or the like, can be mounted on the quick-assembly support according to the invention as well.

LIST OF REFERENCE SIGNS

11 Quick-assembly support
12 Support plate
13, 14 Elongated holes
15-18 Longitudinal edges (elongated holes)
19 First fastening element
20 Second fastening element
21 First interlock surface
22 Second interlock surface
23, 24 Frame elements
25, 26 Retaining section
27 Underside
28, 29 Legs (spring clips)
30 Upper side (quick-assembly support)
31 Fastening means (quick-assembly support), adhesive pad
33, 34 Lateral edges
35 Free space
36, 37 Effect devices
38 Base plate
39 Catch lug
40 Projections
L Axis
A Grid spacing

What is claimed:

1. A set for mounting electronic components on a pedalboard, comprising a support plate, said support plate comprises a plurality of elongated holes arranged in parallel in a predetermined pattern, wherein pairs of elongated holes with a first elongated hole and a second elongated hole are arranged in a predetermined grid spacing (A) perpendicular to longitudinal extension of two elongated holes, wherein the elongated holes comprise straight longitudinal edges extending parallel to one another, said support plate having a first side and a second side, said first side being opposite the second side;

lateral frame elements, said lateral elements being angled such that one end of each element has a shorter length than a second end of each element, said lateral frame elements comprising a first lateral frame element disposed on said first side of the support plate and a second lateral frame element disposed on said second side of the support plate, wherein a free space is formed below the support plate and between the lateral frame elements, wherein said free space accommodates cabling, wherein said free space accommodates a power supply unit; and at least one quick-assembly support, said quick-assembly support comprising a base plate, a first fastening element and a second fastening element, said base plate defined on an upper side of the support, said base plate being dimensioned and configured to receive an effect device, each said first fastening element and said second fastening element facing away from the upper side of the support, each said first fastening element and said second fastening element being a substantially U-shaped spring clip with a first leg and a second leg, wherein each said first fastening element and said second fastening element being dimensioned and configured to match the grid spacing (A), wherein said substantially U-shaped spring clip with a first leg and a second leg of said first fastening element being dimensioned and configured to interlock with the first elongated hole and said substantially U-shaped spring clip with a first leg and a second leg of said second fastening element being dimensioned and configured to interlock with the second elongated hole.

2. The set of claim 1, wherein said first fastening element and said second fastening element of the quick-assembly support interlocks with the longitudinal edges of the first elongated hole and the second elongated hole, wherein said first fastening element and said second fastening element face one another.

3. The set of claim 1, wherein said first fastening element and said second fastening element of the quick-assembly support interlocks with the longitudinal edges of the first elongated hole and the second elongated hole, wherein said first fastening element and said second fastening element face away from one another.

4. The set of claim 1, wherein said first fastening element and said second fastening element are resiliently constructed wherein each fastening element can be manipulated to the elongated holes by overcoming a predetermined spring force.

5. The set of claim 1, wherein a first interlock surface of the first fastening element and a second interlock surface of the second fastening element, interlocks with the longitudinal edge of the respective elongated hole.

6. The set of claim 1, wherein a retaining section of each said first and said fastening element encloses the associated longitudinal edge of the support plate and rests against an underside of the support plate.

7. The set of claim 1, wherein a distance between the first leg and the second leg of each U-shaped spring clip corresponds to a width of the elongated holes.

8. The set of claim 1, wherein the upper side of the quick-assembly support provides effect device fastening means.

9. The set of claim 1, wherein the fastening means comprise a self-adhesive surface.

10. The set of claim 1, wherein the fastening means comprise a predetermined width B parallel to the longitudinal extension of the elongated holes, wherein lateral displacement with simultaneous axial guidance within the elongated hole is feasible.

11. The set of claim 1, wherein the quick-assembly support is held on the support plate with a predetermined pretensioning without play in a direction perpendicular to the surface of the support plate.

* * * * *